US005273548A

United States Patent [19]

Lapierre et al.

[11] Patent Number: 5,273,548

[45] Date of Patent: Dec. 28, 1993

[54] METHOD OF CONTROLLING THE SHIRNKAGE OF GARMENTS CONTAINING COTTON

[75] Inventors: William F. Lapierre; Kris Swamy, both of Lumberton, N.C.

[73] Assignee: West Point-Pepperell, Inc., West Point, Ga.

[21] Appl. No.: 687,763

[22] Filed: Apr. 18, 1991

Related U.S. Application Data

[63] Continuation of Ser. No. 418,806, Oct. 3, 1989, abandoned, which is a continuation-in-part of Ser. No. 266,811, Nov. 3, 1988, abandoned, which is a continuation-in-part of Ser. No. 127,849, Dec. 1, 1987, abandoned.

[51] Int. Cl.[5] ..... D06M 13/00; D06M 13/432

[52] U.S. Cl. ..... 8/116.1; 8/115.7; 8/185; 8/DIG. 1

[58] Field of Search ..... 8/115.7, 116.1, 185, 8/DIG. 1; 2/243 R

[56] References Cited

U.S. PATENT DOCUMENTS

| | | | |
|---|---|---|---|
| 2,785,948 | 3/1957 | Abrams | 8/120 |
| 2,839,429 | 6/1958 | Marsh et al. | 8/DIG. 1 |
| 2,974,432 | 3/1961 | Warnock et al. | 8/185 |
| 3,829,288 | 8/1974 | Deiner et al. | 8/185 |
| 4,396,391 | 8/1983 | North | 8/185 |
| 4,421,880 | 12/1983 | Hunsucker et al. | 8/185 |

*Primary Examiner*—Prince Willis, Jr.
*Assistant Examiner*—Alan D. Diamond
*Attorney, Agent, or Firm*—Schweitzer Cornman & Gross

[57] ABSTRACT

The present invention involves a process whereby fabric constructed of 100% or primarily cotton fabric is treated to produce fabric which will have a predicted degree of shrinkage and density. Garments are constructed oversize from such prepared fabric to allow for the predicted shrinkage. The garments are moisturized within a range of 15%-30% while the garments are being agitated and subsequently tumble-dried. Such garments shall have reduced residual shrinkage of up to 95%, superior hand and appearance.

3 Claims, 1 Drawing Sheet

METHOD OF CONTROLLING THE SHIRNKAGE OF GARMENTS CONTAINING COTTON

RELATED APPLICATIONS

This application is a continuation of Ser. No. 07/418,806, filed Oct. 3, 1989 now abandoned, which is a continuation-in-part of our co-pending application Ser. No. 07/266,811, filed Nov. 3, 1988, which in turn was a continuation-in-part of application, Ser. No. 07,127,849 filed Dec. 1, 1987, both now abandoned.

BACKGROUND OF THE INVENTION

The present invention concerns a unique method for fabricating garments made of fabrics whose essential and primary fiber is cotton to produce garments having attributes far superior to those produced by present conventional methods. The finished garments made according to the inventive process will have significantly less shrinkage than those conventionally produced when laundered and subjected to tumble drying. The garment at point-of sale has: superior fit that is, has not been made significantly oversized or need not be purchased oversized by the consumer to allow for subsequent shrinkage; garments produced by the invention have remarkably soft hand and there is much less deterioration of the cotton fabric's tensile and burst strength characteristics which, invariably, results from conventional use of resins to control shrinkage.

Heretofore shrinkage control of cotton fabric, particularly 100% cotton fabric has been achieved to a greater or lesser extent by the use of mechanical preshrinkage techniques which generally compact or crimp the cotton fibers of woven or knitted fabric, thereby attempting to place such fabric in a less shrinkable condition. Such mechanical preshrinkage is accomplished by the use of rubber belts, shoes, rollers, stuffing boxes, doctor blades and the like. Mechanical preshrinkage systems have certain drawbacks. Generally speaking, fabric is processed at relatively slow speeds which inhibit production; and the process of subjecting tubular knit fabric to mechanical compaction invariably provides a "one-sidedness" to the fabric which creates problems when the fabric is cut and sewn and made into finished garments. Further, a knit garment composed of various styles or constructions may have some parts compacted and with luster and additional one-sided effects and others, for example, ribs and collars that are not and cannot be subjected to compaction, will differ in appearance from a visual and feel point of view and thus is undesirable. Compacting is not effective on resinated and fully-cured fabrics. Moreover, mechanical preshrinking systems are generally fairly expensive because of the capital investment in equipment and reduced production speed.

With the advent of polyester/cotton blends and the resin treatment of fabrics to provide durable press or wash and wear characteristics, less need has existed to resort to mechanical shrinkage control since the synthetic fibers can be heat set and resin treatment of the cotton component further imparts a degree of shrinkage stabilization.

It has been known for a number of years that cross linking chemicals can be used in order to impart shape-holding properties - wrinkle resistance, wash-wear properties and above all dimensional stability. The present art of crosslinking finishes or resins as they are called in the trade evolved around formaldehyde-based condensation products with urea or urea derivatives. The chemistry and manufacturing methods are well known to those involved in the textile trade. Examples of some of the chemicals used or being used are given below:

dimethylolurea, dimethylol ethylene urea, dimethylol alkyl carbamate, trimethylolmelamine, dimethylol dihydroxyethylene urea, and modified or substituted dimethylol dihydroxy ethylene ureas.

The chemical structure of the last product which is being used very widely at present is as follows:

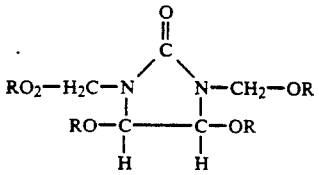

where R=—H (dimethylol dihydroxy ethylene urea) or —$CH_3$, or —R'—OH. It is beyond the scope of this description to give details of the chemistry and properties of various formaldehyde-based adducts as cross linking agents. They are described in detail in well known published textbooks and articles such as "Crease Resisting Fabrics" by J. T. Marsh, Reinhold Publishing Corporation, New York, 1962, "Chemical Aftertreatment of Textiles" Edited by H. Mark, Norman S. Wooding and Sheldon M. Atlas, Wiley Inter-Science, a Division of John Wiley and Sons, Inc., New York, 1971, and 2-Imidazolidinones (Ethylene Ureas)—A review by P. K. Shenoy and John W. Pearce, American Dyestuff Reporter, May 6, 1968. At present, the chemical methods to control the shrinkage of cotton fabrics or garments is by the use of crosslinking resins, hereafter referred as resins, such as DMDHEU (dimethylol dihydroxy ethylene urea) or modified derivatives. However, resination of fabric is not fully effective. In order to achieve a degree of shrinkage control of say, no more than five percent, producers of fabric must use approximately fifteen to twenty-five percent of resin by weight of fabric. This amount of resin will reduce the tear and burst strength of cotton fiber by about fifty percent. Moreover, the resin imparts a stiffness to the fabric resulting in extremely poor hand.

There have been attempts to control the shrinkage of cotton garments by producing such garments oversized and then washing and tumble drying to size. This technique is feasible where the garments are expected to have a washed or stone-washed look. However, the cost of producing garments of this type is high and the appearance of the garments is mussy or worn. There have been attempts to treat fabric of 100% cotton by using washing and drying techniques to cause the cotton to shrink fully so that garments made of the preshrunk fabric shrink minimally or not at all. However, it is not possible using this technique to produce material on a continuous production basis since the fabric while being washed must be in relatively short lengths. There have been attempts to achieve shrinkage by moistening the fabric, subjecting it to agitation and thereafter drying by hot air on a continuous basis. This process has been only partially successful in providing shrinkage control since it is relatively impossible to provide total relaxation of the fabric during the regular production process.

An attempt has been made as shown in U.S. Pat. No. 3,597,851 (Arendt) to reduce the residual shrinkage of textile materials of relatively short pieces or of finished garments (both natural and synthetic fibers) by subjecting synthetic fabric to heat and tumbling alternatively in one direction and then in the other and by repeatedly moistening cotton material with water or steam and tumble drying after each moistening to reduce shrinkage to low levels. This process does not teach the precise control of fabric preparation and subsequent garment manufacture and shrinkage required to achieve the benefits of the present invention process. Moreover, the process described in the patent in respect to cotton fabric would produce a washed look at point-of-sale because of repeated moistenings and tumble drying.

SUMMARY OF THE INVENTION

In accordance with the method of the invention, a textile fabric essentially constructed of cotton fibers is precisely constructed to have a uniform geometrical relationship and uniform dimensional forces between the yarns thereof. Such fabric is finished by applying thereto a liquid mixture containing a resin (for example DMDHEU), the quantity of resin being sufficient to permit a prescribed degree of initial shrinkage of the fabric (5%-20%) (measured by AATCC Test Method 135) when the fabric is impregnated with moisture (15%-30% by weight) and then tumble dried.

Taking the fabric which has preferably been constructed oversize to compensate for the prescribed initial shrinkage, garments are then constructed oversize to compensate for such shrinkage. A quantity of garments are placed into an apparatus (for example a commercial dryer) in which they are agitated by tumbling while the fabric of said garment is impregnated with water or steam from about 15%-30% by fabric weight. Thereafter, the garments are tumble-dried and are individually pre-shrunk to a prescribed size. In accordance with the disclosure herein, the method of the invention has been applied to knit fabric and knit garments wherein the fabric and garments have been treated with resin to allow for an initial shrinkage of about 10%. The invention produces garments which when washed and tumble dried threreafter will reduce total shrinkage up to 95%.

BRIEF DESCRIPTION OF THE DRAWING

The single FIGURE includes a series of graphical illustrations relating to the proportionate yield (yards per pound) and width in ratio to courses per inch or inches of input yarn per feed per revolution at zero by zero shrinkage (zero shrinkage in width and zero zero shrinkage in length or at "Z/Z"). This knowledge allows the correct prediction of input yarn in order to arrive at the correct fabric yield prior to treatment described in this document. In order to develop such data several experiments were conducted varying the courses per inch or knitting input inches and then processing the samples to get zero by zero shrinkage and also different levels of shrinkage, for example, 5 percent shrinkage in length direction and 10 percent shrinkage in length direction at different stages of processing.

These variables may be altered as specific end garment fabric yields require. The FIGURE includes lines A through F which may be described as follows:

Figure 1:
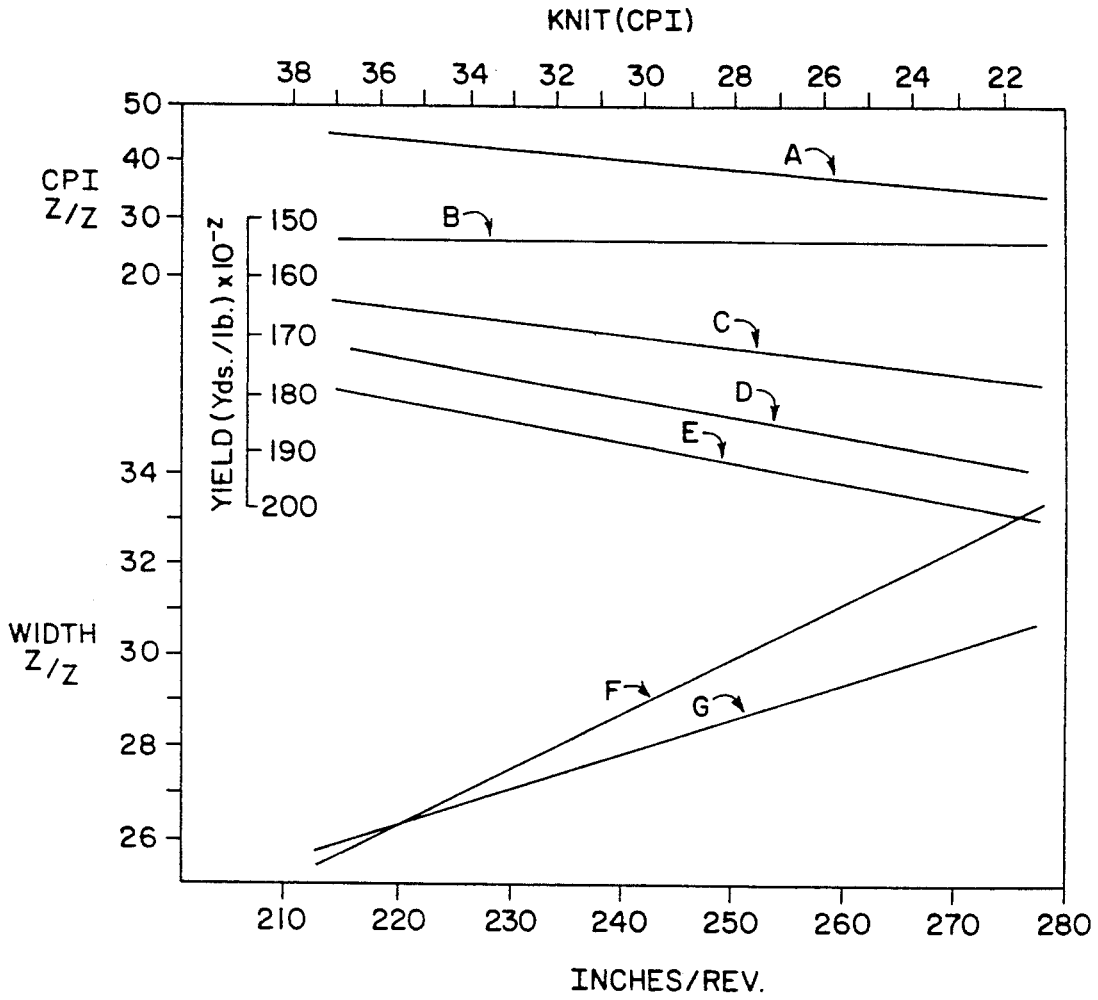

"A" represents greige fabric courses per inch (CPI) at zero by zero (Z/Z) shrinkage levels, the upper horizontal scale representing CPI as knit, and the vertical scale representing CPI after the fabric has stabilized at Z/Z shrinkage.

"B" represents greige fabric linear yield per pound (vertical scale in proportion plotted against to CPI at Z/Z (horizontal scale).

"C" represents resinated fabric yield changing in ratio to knitted CPI at zero shrinkage.

"D" represents resinated fabric yield at 5% residual length shrinkage.

"E" represents resinated fabric yield at 10% residual length shrinkage.

"F" represents greige fabric width at Z/Z changing in ratios to CPI.

"G" represents width of dyed and resinated fabric at Z/Z changing in proportion to CPI but at a different rate than greige fabric.

The top of the X - axis gives the scale of Courses per Inch in the greige fabric after knitting. This can also be controlled by the bottom of the X - axis which is the yarn feed length per revolution per knitting feed (Inches per Revolution). The Y - axis gives the width of fabric at Zero/Zero shrinkage, CPI at Zero/Zero shrinkage as well as the linear yield in Yards per pound of fabric scale.

DESCRIPTION OF PREFERRED EMBODIMENT

Preparation of the Fabric

The concept of the present invention shall be disclosed in relation to knit garments of 100% cotton and more specifically, garments made of circular knitted fabrics. Untreated knitted fabrics of cotton fiber are subject to after wash shrinkage of up to thirty percent, while an untreated woven fabric of cotton generally may shrink a maximum of 10%-15% in length and width. The differences in shrinkage between knit and woven fabric are related to the nature of respective fabric constructions and the differences between knitting and weaving processes. In a knitted fabric, the fabric is formed by a series of interrelated loops which provide give or stretch when worn, while woven fabric is made up of crossing intertwined warp and filling yarns to provide a more restrained fabric web.

It has been discerned that when shrinkage of a knit fabric occurs, by far the greater part of the apparent overall shrinkage of the fabric itself does not consist of foreshortening of the individual yarns. When the fabric is knitted, the loops are of elongated geometrical shape and during shrinkage these loops attempt to become circular in shape. The use of finishing resins, such as DMDHEU or modified derivatives, tends to inhibit the deformation of such loops, that is, will restrain the tendency of such loops to become circular.

It is a primary and important aspect of the present invention that fabric, whether knitted or woven be prepared for subsequent precision shrinkage of a predetermined amount after the said fabric has been converted into garments. The examples given herein shall be with respect to knitted 100% cotton fabric and will prepare such fabric for a subsequent predicted percent shrinkage in length and width in the garment phase.

The first step in achieving precision controlled shrinkage requires the fabric to be knitted uniformly. The single most important factor in this respect is the monitoring of yarn feed to assure that the yarns are of the same prescribed length or lengths. Reference is made to FIG. 1 which assumes such uniformity. Fabric with ten percent residual shrinkage is less dense than fully shrunk fabric. A knitting machine produces fabric based on the amount of yarn fed to it. At low input feed rates the fabric is dense and at long feed rates the fabric is loose. Yield or weight is important and can be predicted based on the data here.

For instance, as shown in Curve C for a resinated fabric knit to yield 1.65 yards per pound, fabric may be knit at a feed rate of 219 inches per revolution and would achieve this yield at zero shrinkage. If we allow for ten percent fabric or garment shrinkage as in Curve D we would knit for a yield of 180 by utilizing a feed rate ten percent higher or 240 inches per revolution. This fabric could then be finished ten percent longer and wider for cut and sew, and during the garment shrinkage treatment, as later explained, would be shrunk ten percent and have a fabric density of 1.65 yards per pound.

By way of additional examples, if three samples at different CPIs were knit, say, 35, 30 and 25, then the greige CPI at the Zero/Zero shrinkage levels (greige fabric) will be from the FIGURE, 43.5, 40.0, and 37.5 CPI's respectively (intersection of the X -axis points 35, 30 and 25 to the Y - axis from line "A"). From line "B", it is obvious the greige fabric yield at zero by zero shrinkage would be 1.538. Line "B", namely greige yield is a straight line at zero/zero shrinkage even though the knit CPI may vary, because at different knitting CPI, the fabric construction may be very loose or very tight and when one obtains zero/zero shrinkage, the fabric relaxes proportionately to the different knitting CPI or feed length resulting in the same yield in proportion to the width change. Line "E" represents the yield at 10% length shrinkage. For Knit CPI of 35, 30 and 25 respectively, the yield of fabric at 10% shrinkage levels would be 1.82, 1.89, and 1.96 respectively. Line "C" which depicts the relationship of fabric yield at zero/zero shrinkage, give fabric yields of 1.66, 1.70, and 1.74 linear yards per pound of fabric. One can easily see that the fabric yield is lower (fabric heavier) at zero/zero shrinkage and at 10% shrinkage, the yields are higher (fabric is lighter and may subsequently shrink during washing). Line "D" for 5% shrinkage, falls between Line "C (zero percent shrinkage) and Line "E" (10 percent shrinkage). Lines "F" and "G" represent width of greige fabric and dyed and resin finished fabrics, respectively, both at zero/zero shrinkage. Once again for the three Knit CPI courses mentioned above (35, 30 and 25 CPI), the respective widths are 26.0, 29.0, and 31.4 inches for greige fabrics and 25.0, 28.0. and 29.6 inches for dyed and resin finished fabrics (all at zero/zero shrinkage).

By knowing the final width and final finished fabric yield and knowing the final fabric shrinkage requirements, one can design and construct the fabric at different shrinkage requirements. The fabrics mentioned in the examples given are designed and constructed using these data and the final performance of the process described herein may be predictable in garment form from the point of view of not only the shrinkage performance but also the final fabric yield or weight.

After the fabric is knitted as illustrated by the examples provided above, in accordance with a further aspect of the invention, the fabric (Jersey) shall be finished by padding on a finishing mixture which for illustrative purposes may be described to include the following listed chemical constituents:

| | PERCENTAGE BY WEIGHT | |
|---|---|---|
| | Recipe for this invention | Conventional Circular Knit finishing |
| Resin - thermosetting, modified DMDHEU type or derivatives | 7:00–10.00 | 15.00–25.00 |
| Catalyst - Magnesium Chloride (usually 15% of resin) | 1.05–1.50 | 2.25–3.75 |
| Softeners (sewing lubricants, hand modifiers) | 1.00–2.00 | 2.00–10.00 |
| Water | To make up 100% | To make up 100% |

The normal finishing method is to saturate the textile substrate with the above mentioned finishing composition followed by squeezing out the excess chemicals through a pad mangle or other means and then drying and baking in a oven at temperatures of 290°–350° F. for about 30 seconds to 5 minutes so that the water can be evaporated first followed by condensing or crosslinking the resinous compounds to the cellulose substrate. Depending upon the reactivity of the crosslinking resin and the catalyst activity, the temperature of curing (condensing temperature) can vary from as low as 290° F. to as high as 350° F. The dwell time (reaction time) vary inversely with the cure temperature. In other words, longer curing times are used for lower temperature and shorter times at higher temperatures.

The foregoing method of reacting cellulose based substrates is called the dry curing process. Although other methods of reacting the crosslinking resin can be used, such as wet fixation, wherein the wet fabric, treated with the cross linking resin, is stored at room temperature or is subjected to wet steam (for example, see U.S. Pat. No. 3,374,107, James F. Cotton, Patented Mar. 19, 1968), the preferred method is by the dry curing process, due to controllable reactions, rather than the wet fixation method which takes too long and is very cumbersome.

The chemicals listed are commercially available and normally used by the textile industry and at the individual chemical's active, solids concentrations, that are normally encountered in the trade.

In addition to the cross linking resin and the reacting catalyst, namely magnesium chloride, the purpose of various additive chemicals is to impart sewability and lubricity characteristics, in order to facilitate manufacture of the garment from the fabric, and to impart other properties such as "handle" and feel of the resultant garment. These chemicals with reference to this invention do not contribute shrinkage or dimensional stability characteristics. Similarly, other chemicals can be used in the treating bath to impart different fabric characteristics such as soil release, stain release, stiffer hand, etc., as desired.

The above comparison is intended only as an example to provide an insight into the lower levels of chemicals requirements, and in this case at least 15% less and up to a maximum of 50% less chemical requirements, and to demonstrate the inherent disadvantages of the moderate strength loss and stiffer handle as a result of the large amounts of crosslinking chemicals necessary with the conventional circular knit goods processing and finishing.

Examples of shrinkage results by this invention compared to those by the conventional method are provided in the following examples. These examples give performance of various fabric constructions and garments constructed from them. In the examples the term Inventive Cotton Process or ICP refers to this invention and the term shrinkage or residual shrinkage are according to the standard methods practiced in the textile manufacturing, garment manufacturing and retail merchants industries, and refer to one or more of the following test procedures:

American Association of Textile Chemists and Colorists (AATCC) Technical Manual, Volume 62, 1987 and reference to the following test methods:

Method 135 - 1978 Dimensional Changes in Automatic Home Laundering of Woven or Knit Fabrics Method 150 - 1984 Dimensional Changes in Automatic Home Laundering of Garments Method 160 - 1980 Dimensional Restoration of Knitted and Woven Fabrics After Laundering J C Penney Standard Test Method MTC - 305, Jul. 1, 1982 Dimensional Stability of Textiles and Textile Products to Various Cleaning Procedures

EXAMPLE 1

A 100% cotton interlock construction knit garment (ladies pullover type) made from 36 Ne yarn and having a weight of 4.9 ounces per square yard was processed through the following finish formulations, designated as Finish Mixes A and B:

| | Finish Mix A | Finish Mix B |
|---|---|---|
| | Percentage by Weight | |
| Resin, DMDHEU | 10.00 | 22.50 |
| Catalyst. Magnesium Chloride | 1.50 | 3.38 |
| Polyethylene based softener | 2.00 | 4.00 |
| Silicone lubricant | 1.00 | 2.00 |
| Water | To make up 100% | To make up 100% |

Fabrics were padded through pad mangle, extracted at 84% wet pick up dried at 275° F. followed by curing at 340° F. for 90 seconds.

The physical test results of the treated fabrics are as follows:

| | Finish Mix A | Finish Mix B |
|---|---|---|
| Strength (Mullens) | 72 | 41 |
| | Residual Shrinkage (% Width × % Length | |
| Shrinkage in the "as is" original state, after one home wash | 10.00 × 7.00 | 8.50 × 5.00 |
| Shrinkage after the "ICP" and after one home laundering and dry cycle | 2.00 × 3.00 | 3.50 × 3.00 |
| Shrinkage after the "ICP" and after three home laundering and dry cycles | 2.50 × 3.50 | 4.50 × 3.50 |

The fabrics from Finish Mix A gave softer handle with higher fabric strength, whereas fabric from Finish Mix B resulted in stiffer handle and extremely lower strength and was not acceptable. Even though, Finish Mix A resulted in higher fabric shrinkage after washing, yet after treatment by the inventive process, the fabric gave substantively lower levels of shrinkage after home washing. Further, the higher fabric strength was retained, whereas the same fabric treated with Finish Mix B, eventhough, gave relatively lower shrinkage results in the beginning, yet after the inventive process did not improve in the residual shrinkage when compared to the fabric treated with relatively lower amounts of resins and chemicals and further processed through the inventive process. Fabric treated with finish Mix B, in addition to stiffer handle, and extremely lower strength retention, was found to be unsuitable for sewing or garment construction. With higher amounts of resin and hence the higher level of crosslinking, the fabric during the subsequent process is unable to restore and relax thus restricting the fabric bulking.

EXAMPLE 2

A 100% cotton men's shirt in pique knit construction dyed red color) made from 18 Ne yarn and having an initial weight of 5.7 ounces per square yard had the following performance characteristics:

| | SHRINKAGE (% WIDTH × % LENGTH) | | | |
|---|---|---|---|---|
| | Finish Mix A | | Finish Mix B | |
| | Single ICP Treatment | Double ICP Treatments | Single ICP Treatment | Double ICP Treatment |
| Strength (Mullens) | 58 | | 32 | |
| Shrinkage in the "as is" original state | 7.50 × 8.50 | | 5.00 × 5.00 | |
| After the "ICP" and one home laundering and drying cycle | 1.40 × 0.90 | 1.00 × 2.30 | 2.00 × 2.00 | 1.80 × 1 |
| After the "ICP" and two home laundering and drying cycles | 2.00 × 1.50 | 1.80 × 2.30 | 2.40 × 2.00 | 2.20 × 1 |
| After the "ICP" and three home laundering and drying cycles | 2.30 × 1.00 | 0.80 × 1.30 | 2.30 × 2.00 | 2.20 × 1 |
| After the "ICP" and four home laundering drying cycles | 1.30 × 1.50 | 1.20 × 1.40 | 1.80 × 2.10 | 2.00 × 1 |

Once again, the finish formulations are same as in Example 1 above, with the exception of the percent wet pick up, which is 80% with both the Finish Mixes A and B. the processing conditions are same as in Example 1.

EXAMPLE 3

A 100% cotton men's shirt in pique construction made from 18 Ne yarn and having unit weight of 5.70 ounces per square yard had the following performance characteristics:

| | SHRINKAGE (% WIDTH × % LENGTH) |
|---|---|
| Fabric strength (Mullens) | 62 |
| Shrinkage in the original state after 1 home launder/dry cycle | 6.00 × 9.00 |
| Shrinkage in the original state and after 2 home launder/dry cycles | 6.00 × 9.80 |
| Shrinkage in the original state and after 3 home launder/dry cycles | 7.00 × 10.00 |

| | Single ICP Treatment | Double ICP Treatments |
|---|---|---|
| Fabric strength (Mullens) | 64 | 64 |

-continued

| | Single ICP Treatment | Double ICP Treatments |
|---|---|---|
| After the "ICP" and one home launder/dry cycle | 2.00 × 3.50 | 2.00 × 4.00 |
| After the "ICP" and two home launder/dry cycles | 2.00 × 5.00 | 1.50 × 4.30 |
| After the "ICP" and three home launder/dry cycles | 2.50 × 5.30 | 2.50 × 5.00 |

The fabric is similar in construction as in Example 2 but dyed with different color (pink). The finish formulation is same as Finish Mix A.

EXAMPLE 4

A 100% cotton men's shirt in Pique construction made from 18 Ne yarn and having unit weight of 6.11 ounces per square yard had the following performance characteristics:

| | SHRINKAGE (% WIDTH × % LENGTH) |
|---|---|
| Shrinkage in the original state after 1 home launder/dry cycle | 9.50 × 6.00 |
| Shrinkage in the original state and after 2 home launder/dry cycles | 9.30 × 7.00 |
| Shrinkage in the original state and after 3 home launder/dry cycles | 9.00 × 7.00 |

| | Single ICP Treatment | Double ICP Treatments |
|---|---|---|
| After the "ICP" and one home launder/dry cycle | 2.00 × 3.50 | 1.00 × 3.50 |
| After the "ICP" and two home launder/dry cycles | 2.00 × 5.00 | 0.80 × 4.50 |
| After the "ICP" and three home launder/dry cycles | 3.00 × 5.30 | 1.20 × 5.00 |

The finish recipe for the fabric in Example 4 above is as follows:

| | Finish Mix C |
|---|---|
| Resin, DMDHEU | 12.00 |
| Catalyst, Magnesium Chloride | 1.80 |
| Polyethylene based softener | 3.00 |
| Water | To make up 100% |

The resin and catalyst levels were increased from Finish Mix since the fabric is heavier in weight and the silicone softener was not used. Processing conditions are: 85% wet pick up; drying temperature is 275° F.; curing conditions: 340° F. for 3 minutes.

As can be seen from the results, the initial shrinkage in the "as is" sample is high (9.50×6.00 percent) but after one ICP treatment, the residual shrinkage becomes 2.00×3.50.

EXAMPLE 5

The garments made from fabric in Example 2 were tested after single and multiple home wash and tumble dry cycles. The average test results are summarized below:

| | ICP + 1 wash | ICP + 3 wash | ICP + 5 wash |
|---|---|---|---|
| Average Shrinkage % Width × % Length | +0.01 × 3.80 | 0.47 × 3.90 | 0.44 × 3.44 |
| Number of garments | 19 | 19 | 17 |
| Standard Deviation | 1.31 × 1.30 | 1.24 × 1.27 | 0.91 × 1.65 |

+ means growth rather than shrinkage.

EXAMPLE 6

Another set of garments made from a similar fabric as in Example 5 above but of different color (purple) and having a weight of 5.20 ounces per square yard gave the following performance values after the Inventive Cotton Process (ICP) and after several home wash and dry cycles:

| | ICP + 1 wash | ICP + 3 wash | ICP + 5 wash |
|---|---|---|---|
| Average Shrinkage % Width × % Length | 0.05 × 2.75 | 0.48 × 2.78 | 0.35 × 3.78 |
| Number of garments tested | 46 | 46 | 42 |
| Standard Deviation | 1.19 × 1.17 | 0.94 × 1.42 | 1.20 × 1.30 |

EXAMPLE 7

The garment in Example 3 with a weight of 5.7 ounces per square yard had the following measurements: The garments had only single treatment of ICP.

| | Original "as is" state | After "ICP" | After "ICP" and 1 wash/ dry cycle | After "ICP" and 5 wash/ dry cycles |
|---|---|---|---|---|
| Bust | 39.58 | 37.75 | 37.17 | 36.92 |
| Shoulder | 15.58 | 15.08 | 14.77 | 14.58 |
| Length | 27.88 | 27.15 | 26.10 | 25.56 |
| Sleeve Length | 7.40 | 7.24 | 7.08 | 6.97 |
| Sweep | 41.83 | 40.17 | 39.21 | 39.17 |
| Armhole | 17.83 | 17.38 | 16.73 | 16.42 |

Total number of garments tested: 6

The following garments had two treatments of ICP.

| | Original "as is" state | After "ICP" | After "ICP" and 1 wash/ dry cycle | After "ICP" and 5 wash/ dry cycles |
|---|---|---|---|---|
| Bust | 39.75 | 37.58 | 37.25 | 37.04 |
| Shoulder | 15.67 | 15.06 | 14.77 | 14.65 |
| Length | 27.90 | 26.88 | 26.02 | 25.40 |
| Sleeve Length | 7.50 | 7.10 | 7.15 | 7.00 |
| Sweep | 41.92 | 40.17 | 39.75 | 39.50 |
| Armhole | 17.88 | 17.31 | 16.88 | 16.54 |

Total number of garments tested: 6

EXAMPLE 8

The garment in Example 4 (weight 6.11 ounces per square yard) had the following measurements after each stage of process:

The garments had only single treatment of ICP.

| | Original "as is" state | After "ICP" | After "ICP" and 1 wash/ dry cycle | After "ICP" and 5 wash/ dry cycles |
|---|---|---|---|---|
| Bust | 39.63 | 36.84 | 36.20 | 36.04 |
| Shoulder | 15.61 | 14.73 | 14.58 | 14.42 |
| Length | 27.88 | 27.59 | 26.83 | 26.31 |
| Sleeve Length | 7.50 | 7.31 | 7.16 | 7.00 |
| Sweep | 41.81 | 38.72 | 37.92 | 38.13 |
| Armhole | 17.93 | 17.27 | 17.02 | 16.81 |

Total number of garments tested: 6

The garments had two treatments of ICP.

| | Original "as is" state | After "ICP" | After "ICP" and 1 wash/ dry cycle | After "ICP" and 5 wash/ dry cycles |
|---|---|---|---|---|
| Bust | 39.47 | 36.38 | 36.08 | 36.13 |
| Shoulder | 15.63 | 14.77 | 14.63 | 14.50 |
| Length | 28.14 | 27.56 | 26.85 | 26.33 |
| Sleeve Length | 7.51 | 7.27 | 7.11 | 6.95 |
| Sweep | 41.69 | 38.34 | 38.04 | 38.00 |
| Armhole | 18.00 | 17.14 | 16.69 | 16.90 |

Total number of garments tested: 6

In Examples 7 and 8 above, the measurements were made to the nearest one-eighth of an inch and the average values reported in decimal fractions.

The results of Examples 7 and 8 is summarized below:

Summary of Example 7

| | Percent Shrinkage ICP Treatments | | | |
|---|---|---|---|---|
| | Single | | Double | |
| | 1 wash | 5 washes | 1 wash | 5 washes |
| Bust | 1.54 | 2.20 | 0.88 | 1.44 |
| Shoulder | 2.06 | 3.32 | 1.93 | 2.72 |
| Length | 3.87 | 5.86 | 3.20 | 5.51 |
| Sleeve Length | 2.21 | 3.73 | 0.70 | 1.41 |
| Sweep | 2.39 | 2.49 | 1.05 | 1.67 |
| Armhole | 3.74 | 5.52 | 2.48 | 4.45 |

Summary of Example 8

| | Percent Shrinkage ICP Treatments | | | |
|---|---|---|---|---|
| | Single | | Double | |
| | 1 wash | 5 washes | 1 wash | 5 washes |
| Bust | 1.74 | 2.17 | 0.82 | 0.69 |
| Shoulder | 1.02 | 2.10 | 0.95 | 1.83 |
| Length | 2.75 | 4.64 | 2.58 | 4.46 |
| Sleeve Length | 2.05 | 4.24 | 2.26 | 4.40 |
| Sweep | 2.07 | 1.52 | 0.78 | 0.89 |
| Armhole | 1.45 | 2.66 | 2.63 | 1.40 |

Summary of Garment Shrinkage Tests (Examples 7 and 8):

| | % Width × % Length | |
|---|---|---|
| | 1 Cycle ICP | 2 Cycles ICP |
| Example 7: | | |
| 1 Wash | 2.45 × 2.82 | 1.76 × 1.65 |
| 5 washes | 3.68 × 4.03 | 2.87 × 2.86 |
| Example 8: | | |

-continued

| | % Width × % Length | |
|---|---|---|
| | 1 Cycle ICP | 2 Cycles ICP |
| 1 wash | 1.40 × 2.29 | 1.47 × 1.87 |
| 5 washes | 2.31 × 3.47 | 1.31 × 3.25 |

It is an obvious conclusion from the above examples that one single treatment of the inventive process (ICP) is sufficient to reduce the residual shrinkage in the garments to say levels below that of 5 percent in both width and length and that multiple treatments of moisturizing and tumbling does not reduce the shrinkage levels appreciably. Moreover the garments being of knit construction, there is a need for some recovery for comfort, fit and stretching during the normal wear.

EXAMPLE 9

About 1000 pounds of Interlock knit fabrics were prepared using 36/1 Ne 100% cotton yarn. The knitting styles involved both yarn dyed and fabric dyed constructions. These fabric samples were finished with the following finish formulation:

| | Percent Chemicals |
|---|---|
| Resin, DMDHEU | 12.00 |
| Catalyst, Magnesium Chloride | 1.80 |
| Polyethylene softener | 2.00 |
| Silicone softener | 2.00 |
| Water | To make up 100% |

The fabrics were impregnated in the above padding solution to a wet pick up of 80% for fabric dyed styles and 75% wet pick up for yarn dyed styles, dried in an oven at 275° F., followed by curing at 340° F. for 3 minutes. The finished fabrics were tested and the results are given below:

| Lot No. | Style | Width (inches) | Yield (ozs/ sq. yd) | Strength Mullens | Residual Shrinkage % W × % L |
|---|---|---|---|---|---|
| L-047-01B | FD | 64 | 4.90 | 67 | 9 × 5 |
| L-047-02B | FD | 66 | 5.16 | 89 | 11 × 10 |
| L-047-03B | FD | 68 | 4.81 | 57 | 10 × 7 |
| L-047-04B | FD | 67 | 4.88 | 85 | 11 × 11 |
| L-047-05B | FD | 67 | 4.75 | 53 | 10 × 8 |
| L-048-01B | YD | 67 | 5.11 | 53 | 7 × 9 |
| L-048-02B | YD | 68 | 5.36 | 64 | 8 × 10 |
| L-049-01B | YD | 67 | 5.00 | 59 | 11 × 10 |
| L-049-02B | YD | 67 | 5.19 | 53 | 8 × 9 |
| L-050-OIB | YD | 66 | 5.13 | 53 | 9 × 6 |
| L-050-02B | YD | 68 | 5.08 | 49 | 10 × 8 |
| L-051-01B | YD | 67 | 5.07 | 56 | 9 × 8 |
| L-051-02B | YD | 68 | 4.83 | 50 | 7 × 9 |

The term FD refer to greige knitted fabric followed by dyeing in a fabric dyeing machine and the term YD refer to dyeing the yarn first followed by knitting the dyed yarn to produce fabrics having different colors.

Cuts of the fabrics in the above example were then subjected to the subsequent ICP treatment to determine the characteristics. The results after such fabric treatments are given below:

| Lot No. | Width (inches) | Yield (ozs/ sq. yd) | Strength Mullens | Reduction in size % W × % L | Residual Shrinkage % W × % L |
|---|---|---|---|---|---|
| L-047-01B | 64 | 5.40 | 69 | 7 × 7 | 3 × 3 |
| L-047-02B | 66 | 5.72 | 92 | 8 × 8 | 4 × 4 |
| L-047-03B | 68 | 5.05 | 54 | 6 × 3 | 4 × 2 |
| L-047-04B | 67 | 5.39 | 89 | 9 × 7 | 4 × 4 |
| L-047-05B | 67 | 5.07 | 58 | 8 × 5 | 4 × 3 |
| L-048-01B | 67 | 5.50 | 63 | 5 × 5 | 4 × 4 |
| L-048-02B | 68 | 5.60 | 64 | 6 × 6 | 4 × 4 |
| L-049-01B | 67 | 5.68 | 60 | 7 × 7 | 3 × 5 |
| L-049-02B | 67 | 5.43 | 66 | 6 × 5 | 3 × 4 |
| L-050-01B | 66 | 5.62 | 58 | 6 × 6 | 3 × 4 |
| L-050-02B | 68 | 5.42 | 63 | 6 × 5 | 4 × 5 |
| L-051-01B | 67 | 5.63 | 58 | 7 × 7 | 4 × 5 |
| L-051-02B | 68 | 5.56 | 54 | 8 × 6 | 2 × 4 |

The term 'reduction in size' refers to percent shrinkage removal and bulking of the fabric as a result of the subsequent ICP treatment.

Several dozens of garments were constructed from these fabrics and then subjected to the ICP treatment. It is well known that knitted fabrics during the cutting and sewing operation, the cut parts of the garment assembly will be subjected to stretch and pull, and hence, additional shrinkage will be imparted to the finished garments. If the ICP treatment is given after the final assembly of the garment, such a process will also remove the above mentioned shrinkage introduced during the garment assembly phase. This is demonstrated in the final test results of the garments assembled from the fabrics mentioned in this example after the garments have been subjected to the ICP treatment.

| Garment Size: Men's Shirt: Size Large | | | |
|---|---|---|---|
| Measurement Location | Garment in the "As Is" State | After ICP | Percent Size Reduction |
| Chest | 24.77 | 23.06 | 7.42 |
| Bottom Hem | 24.33 | 22.73 | 7.04 |
| Front Length | 31.54 | 29.46 | 7.06 |
| Back Length | 34.50 | 32.23 | 7.04 |

The figures are in inches and represent average values of 6 garments tested.

Another set of garments from a different fabric style were made into Men's shirts: Size Medium and the results are given below:

| Garment Size: Men's Shirt: Size Medium | | | |
|---|---|---|---|
| Measurement Location | Garment in the "As Is" State | After ICP | Percent Size Reduction |
| Chest | 22.02 | 20.38 | 8.05 |
| Bottom Hem | 21.88 | 20.27 | 7.94 |
| Front Length | 30.00 | 28.17 | 6.50 |
| Back Length | 33.10 | 30.92 | 7.05 |

The figures are in inches and represent average values of 6 garments tested.

In another experiment, garments from the above fabrics were tested for residual shrinkage both without the ICP treatment and after the ICP treatment. The results are:

| Garment Identification | Residual Shrinkage after one wash: Without ICP Treatment | With ICP Treatment |
|---|---|---|
| L-047-01B | 10.00 × 8.35 | 2.50 × 4.12 |
| L-048-01B | 8.16 × 10.34 | 1.64 × 5.00 |
| L-049-01B | 11.38 × 10.67 | 0.62 × 3.92 |
| L-050-01B | 10.39 × 7.14 | 0.91 × 3.70 |

EXAMPLE 10

The following example gives the performance of various fabrics differing in weight and knit style constructions:

| Yarn Size | Knit Style | Process | Color | WEIGHT ozs/ sq. yd. | SHRINKAGE "as is" State | After the "ICP" |
|---|---|---|---|---|---|---|
| 36 Ne | Interlock | YD | White | 4.81 | 9.0 × 14.0 | 1.5 × 5.5 |
| 36 Ne | Interlock | YD | White | 5.14 | 8.0 × 20.0 | 2.0 × 5.0 |
| 36 Ne | Interlock | YD | Red | 5.08 | 15.0 × 15.0 | 2.5 × 5.5 |
| 36 Ne | Interlock | FD | Pink | 4.94 | 10.0 × 7.0 | 2.5 × 4.0 |
| 36 Ne | Interlock | FD | Pink | 4.72 | 10.0 × 7.0 | 2.0 × 4.5 |
| 18 Ne | Pique | YD | White/ Red | 6.06 | 7.0 × 25.0 | 1.0 × 6.0 |
| 18 Ne | Pique | YD | White/ Red | 5.28 | 6.0 × 19.0 | 3.0 × 4.5 |
| 8 Ne | Pique | FD | Pink | 5.58 | 6.0 × 11.0 | 1.5 × 2.0 |
| 18 Ne | Pique | FD | Pink | 6.05 | 9.0 × 6.0 | 2.0 × 2.0 |
| 18 Ne | Pique | FD | Pink | 4.99 | 8.5 × 11.5 | 4.0 × 6.0 |
| 18 Ne | Pique | FD | Purple | 5.20 | 7.0 × 8.0 | 4.5 × 4.5 |
| 20 Ne | 2-End Jersey | YD | White | 7.07 | 7.0 × 17.0 | 3.0 × 3.0 |
| 20 Ne | 2-End Jersey | YD | White | 6.21 | 6.0 × 10.0 | 1.0 × 6.0 |
| 20 Ne | 2-End Jersey | YD | Red | 7.72 | 9.0 × 11.0 | 2.0 × 3.0 |
| 20 Ne | 2-End Jersey | FD | Pink | 6.37 | 5.0 × 10.0 | 1.0 × 4.0 |
| 20 Ne | 2-End Jersey | FD | Pink | 6.15 | 4.0 × 15.0 | +1.0 × 4.5 (growth in Width) |
| 20 Ne | 2-End Jersey | FD | Blue | 6.91 | 4.0 × 11.0 | 0.0 × 4.0 |
| 20 Ne | 2-End Jersey | FD | Blue | 6.26 | 8.0 × 18.0 | 0.0 × 5.0 |
| 18 Ne | Jersey | YD | White/ Red | 5.59 | 12.0 × 6.0 | 4.5 × 2.0 |
| 18 Ne | Jersey | YD | White/ Red | 4.98 | 11.0 × 6.0 | 3.5 × 2.0 |
| 18 Ne | Jersey | FD | Pink | 4.64 | 9.0 × 15.0 | 2.0 × 4.0 |
| 18 Ne | Jersey | FD | Pink | 5.49 | 4.0 × 7.0 | 1.0 × 2.0 |
| 18 Ne | Jersey | FD | Blue | 4.79 | 7.0 × 9.0 | 2.0 × 3.0 |
| 18 Ne | Jersey | FD | Blue | 5.31 | 7.0 × 5.0 | 2.0 × 4.0 |
| 18 Ne | 2 × 2 Rib | YD | White | 9.43 | 7.0 × 12.0 | 2.0 × 4.0 |
| 18 Ne | 2 × 2 Rib | YD | White | 8.53 | 15.0 × 22.0 | 5.0 × 9.0 |
| 18 Ne | 2 × 2 Rib | YD | Red | 10.14 | 14.0 × 14.0 | 2.0 × 4.5 |
| 18 Ne | 2 × 2 Rib | YD | Red | 10.79 | 9.0 × 10.0 | 4.5 × 6.5 |
| 18 Ne | 2 × 2 Rib | FD | Pink | 9.75 | 11.0 × 10.0 | 1.5 × 3.0 |
| 18 Ne | 2 × 2 | FD | Pink | 10.66 | 14.0 × | 2.0 × |

-continued

| Yarn Size | Knit Style | Process | Color | WEIGHT ozs/ sq. yd. | SHRINKAGE "as is" State | After the "ICP" |
|---|---|---|---|---|---|---|
| | Rib | | | | 9.0 | 3.0 |
| 18 Ne | 2 × 2 Rib | FD | Blue | 10.32 | 9.0 × 8.0 | 2.0 × 3.0 |
| 18 Ne | 1 × 1 Rib | YD | White | 5.35 | 12.0 × 18.0 | 2.0 × 4.0 |
| 18 Ne | 1 × 1 Rib | YD | White | 6.14 | 14.0 × 13.0 | 3.0 × 4.0 |
| 18 Ne | 1 × 1 Rib | YD | Red | 6.98 | 14.0 × 15.0 | 1.0 × 5.0 |
| 18 Ne | 1 × 1 Rib | YD | Red | 6.39 | 9.0 × 15.0 | 0.0 × 4.0 |
| 18 Ne | 1 × 1 Rib | FD | Pink | 5.66 | 11.0 × 10.0 | 2.0 × 4.5 |
| 18 Ne | 1 × 1 Rib | FD | Blue | 6.17 | 7.0 × 8.0 | 1.0 × 4.0 |
| 18 Ne | 1 × 1 Rib | FD | Blue | 6.02 | 13.0 × 9.0 | 3.0 × 6.0 |

All the fabric samples in the above Example 10 were prepared using Finish Mix A; finish applied through a pad mangle and extracted at 80–85% wet up, dried at 275° F., followed by curing at 340° F. for 3 minutes.

The term "as is" refers to the fabric in the original state and without the process described in this invention, and the term "ICP" refer to the invention process. The numbers represent the shrinkage after one home launder and dry cycle. The term "YD" (Yarn Dyed) refers to yarn dyed fabrics made from yarn that has been colored first prior to knitting, and the term "FD" (Fabric Dyed) refers to fabric dyed process, that is fabric was knitted first from natural yarn followed by dyeing.

The invention does not pertain to only those styles and conventional variations described herein; but these demonstrate the effectiveness of the invention on various fabric styles differing in yarn size, knitting construction and the method of preparing various fabric styling, namely, process variations and methods of achieving different styling concepts. The data also demonstrate that in order to impart very low levels of shrinkage, without the invention process, extremely large levels of resin chemicals are otherwise needed, as evidenced by the high shrinkage in the "as is" samples; but these high residual shrinkage levels after the inventive process (which will be described later) are reduced to very low levels which would otherwise require larger chemical concentrations to achieve the same low levels and the obvious resultant lower strength.

Preparation of Garments

As stated heretofore, in accordance with the present invention, knit cotton fabric shall be knitted "oversize" by an amount corresponding to the degree of shrinkage predicted to occur during subsequent shrinkage of garments made from such fabric. In the examples given above the disclosed quantity of and proportions of chemicals will stabilize shrinkage after garments utilizing knitted cotton fabric subjected to such finishing treatment have been initially preshrunk about 10% in length and width. Therefore the fabric itself will be knitted oversize by 10%, and in terms of yield shall have a decreased density and weight of 10% in respect of its weight before subsequent 10% shrinkage. It follows that each garment shall be constructed oversize by 10% to accommodate the aforementioned shrinkage.

The process of shrinking garments pursuant to the inventive concept shall now be described. A batch (80–150 pounds) of oversize garments (to compensate for 10% shrinkage) will be loaded into a commercial tumble-dryer which has been fitted with means to moisten the garments by spraying these with either steam or water. Treatment is done initially in a uniform manner while tumbling the garments until each garment has absorbed about 15%–30% moisture by weight of fabric in each garment. Immediately thereafter, moisturization shall cease and the garments shall be tumble dried. In the foregoing examples, the garments and fabrics alike were subjected to moisturizing and drying steps; each cycle consists of steaming for 15 minutes followed by tumble drying and cooling for 15 minutes. The examples show a single moisturizing treatment followed by tumble drying is essentially all that is needed for shrinkage control. At this time, each garment shall have been preshrunk approximately 10% to a predetermined size for point of sale. The resulting garment has a "lofty" quality to the hand, without the mussy look which washing or repeated moisturizings would impart. Also, the garment shall have shrunk uniformly in length and width to a prescribed fit which will not shrink out of fit even after many washes.

It will be understood that while the particular embodiments described above relate to knit garments, it is obvious that the process of the invention may be applied to woven as well, since shrinkage control of woven garments is less difficult than for knits. In order to understand fully the scope of the invention reference should be made to the appended claims.

We claim:

1. The method of manufacturing garments, constructed predominantly of cotton fibers, to minimize residual shrinkage of the garments as presented at the point of sale, which comprises (a) initially constructing one or more greige fabrics, from which said garments later will be fabricated, to have predetermined shrinkage characteristics of 5% to 20%, as measured by AATCC Test Method 135, which the fabrics will experience during the further treatment of steps, (d) and (e) hereof, (b) while said fabrics retain their predetermined shrinkage, and prior to cutting and sewing of the garment, impregnating said fabrics with a stabilizing resin and drying the fabric and curing said stabilizing resin, the amount of said stabilizing resin applied to said fabrics being sufficient to impart wash and wear characteristics, but such that said fabrics, during the further treatment of steps (d) and (e) hereof, will be permitted to shrink by the amount of said predetermined shrinkage, (c) while said impregnated fabrics continue to retain said predetermined shrinkage, cutting said fabric and fabricating said garments therefrom such that, when said predetermined shrinkage is later induced in said garments in accordance with steps (d) and (e) hereof, said fabrics and said fabricated garments will stabilize at a desired size, (d) prior to delivery of said garments for sale to consumers, uniformly imparting increased moisture to the fabricated garments, accompanied by constant agitation of said garments, until the moisture content of the fabric of said garments constitutes from about 15% to about 30% by dry weight of the fabric, (e) immediately thereafter drying said garments in a tension-free manner accompanied by constant agitation to controllably induce shrinkage of said garments in amounts to shrink said fabrics and said garments to said desired size, and (f) thereafter delivering said garments for sale.

2. A method according to claim 1, wherein said fabrics are constructed of 100% cotton.

3. A method according to claim 1, wherein said fabrics are of circular knit construction.

* * * * *